US006129563A

United States Patent [19]

Weidner

[11] Patent Number: 6,129,563

[45] Date of Patent: Oct. 10, 2000

[54] BULKHEAD-MOUNTABLE COAXIAL CONNECTOR

[75] Inventor: Kevin Edward Weidner, Hummelstown, Pa.

[73] Assignee: The Whitaker Corporation, Wilmington, Del.

[21] Appl. No.: 09/193,906

[22] Filed: Nov. 18, 1998

[51] Int. Cl.[7] ..... H01R 4/66

[52] U.S. Cl. ..... 439/92; 439/939

[58] Field of Search ..... 439/95, 63, 939, 439/92, 581

[56] References Cited

U.S. PATENT DOCUMENTS

| | | | |
|---|---|---|---|
| 3,453,587 | 7/1969 | Neidecker | 339/256 |
| 3,861,776 | 1/1975 | Deal | 339/74 R |
| 4,120,751 | 10/1978 | Horrocks | 339/252 R |
| 4,874,337 | 10/1989 | Paukovits, Jr., et al. | 439/609 |
| 4,934,960 | 6/1990 | Capp et al. | 439/939 |
| 5,326,280 | 7/1994 | Briones et al. | 439/939 |
| 5,421,751 | 6/1995 | Bennett et al. | 439/943 |

OTHER PUBLICATIONS

AMP Drawing No. 227935, Contact, Series SMA; Mar., 1996; AMP Incorporated, Harrisburg, PA.

AMP Drawing No. 413071–1, Plug, Solder, Series SMA; Oct., 1998; AMP Incorporated, Harrisburg, PA.

AMP Drawing No. 148316, Contact, Female, Coax, Type M; Sep., 1997; AMP Incorporated, Harrisburg, PA.

AMP Drawing No. 148339, Socket Assembly, Coax,, Type M; Sep. 1997; AMP Incorporated, Harrisburg, PA.

*Primary Examiner*—Gary F. Paumen

[57] ABSTRACT

Coaxial connector (10) including an outer conductive housing (16) with a contact band (22) annularly therearound. Contact band (22) includes an array of convex spring members (24) that engage under spring bias the cutout periphery when connector (10) is mounted through the cutout of a bulkhead (32), compressing the spring members radially inwardly into the shallow groove (20) in which contact band (22) is seated.

3 Claims, 2 Drawing Sheets

BULKHEAD-MOUNTABLE COAXIAL CONNECTOR

FIELD OF THE INVENTION

This relates to the field of electrical connectors and more particularly to coaxial connectors.

BACKGROUND OF THE INVENTION

Coaxial connectors generally include an inner or signal conductor in a dielectric housing that is surrounded by an outer or ground conductor such as an outer housing of metal. One such connector is sold by AMP Incorporated, Harrisburg, Pa. as Type "H" having Part No. 148339 for termination to semi-rigid cable.

It is desired to provide a coaxial connector that is adapted to be mounted through a cutout of a bulkhead as a single unit.

It is also desired to provide such a coaxial connector that establishes a ground connection between the outer housing and the conductive bulkhead.

It is further desired that the connector be field removable.

SUMMARY OF THE INVENTION

The present invention provides a coaxial connector having an annular band of inwardly compressible spring members, seated in a shallow groove around the outer surface of the cylindrical outer housing. The spring members are arcuate outwardly and compressible inwardly toward the outer housing and into the shallow groove. When inserted through a bulkhead cutout, the spring members are engaged by the periphery of the cutout and deflected inwardly thereby, establishing a plurality of ground connections between the coaxial connector and the conductive bulkhead. The coaxial connector may easily be removed from the bulkhead to facilitate any repairs or maintenance of the backplane or interconnect system, and still enable continued use of the connector.

An embodiment of the invention will now be described by way of example with reference to the accompanying drawings.

DETAILED DESCRIPTION

Figure 1:
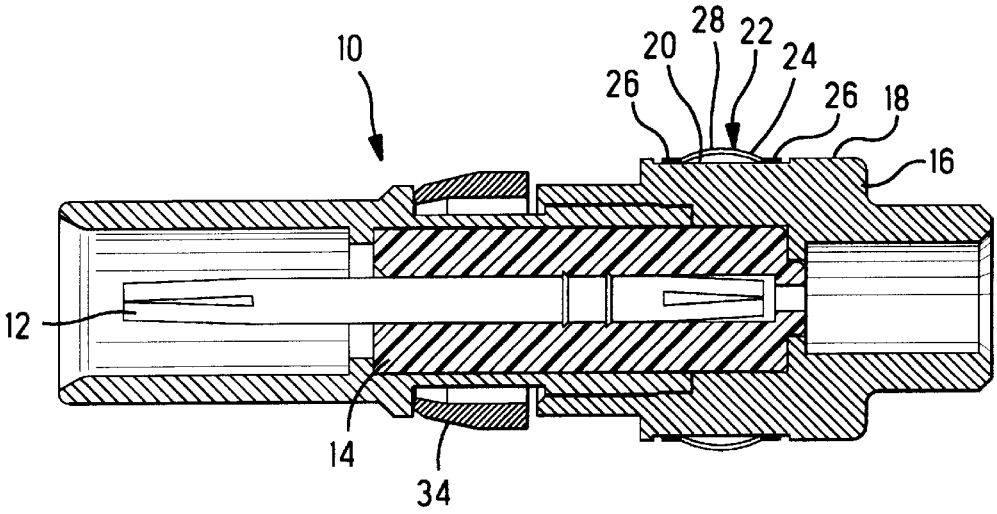
FIG. 1 is a longitudinal cross-sectional view of the coaxial connector, illustrating the annular ground spring.
Figure 2:
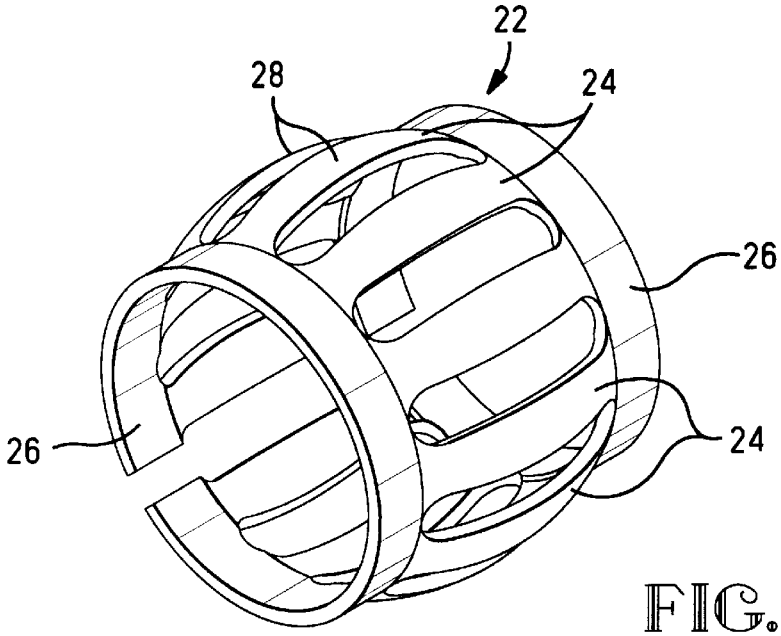
FIG. 2 is an isometric view of the annular ground spring of FIG. 1.

Coaxial connector 10 includes an inner contact 12 within a dielectric housing or insert 14 which in turn is captured within an outer conductor or housing assembly 16 Outer surface 18 of outer housing conductor 16 includes therearound a shallow groove 20 within which is seated an annular ground strip 22. Annular ground contact 22, as seen best in FIG. 2, includes an array of spring members 24 extend axially and are joined at opposed ends to generally continuous annular bands 26, while being arcuate or convex outwardly to contact surfaces 28. One such an annular band of spring members is disclosed in U.S. Pat. No. 3,861,776. Another such annular band is sold by AMP Incorporated, Harrisburg, Pa. under the trademark LOUVERTAC contact band and having Part No. 1-192048-1. Preferably bands 26 are split to enable diametrical expansion to facilitate placement of the ground contact around the outer housing, the annular contact band having spring properties and being preferably made of metal such as gold-plated beryllium copper, after which the bands snap back into the shallow groove.

Figure 3:
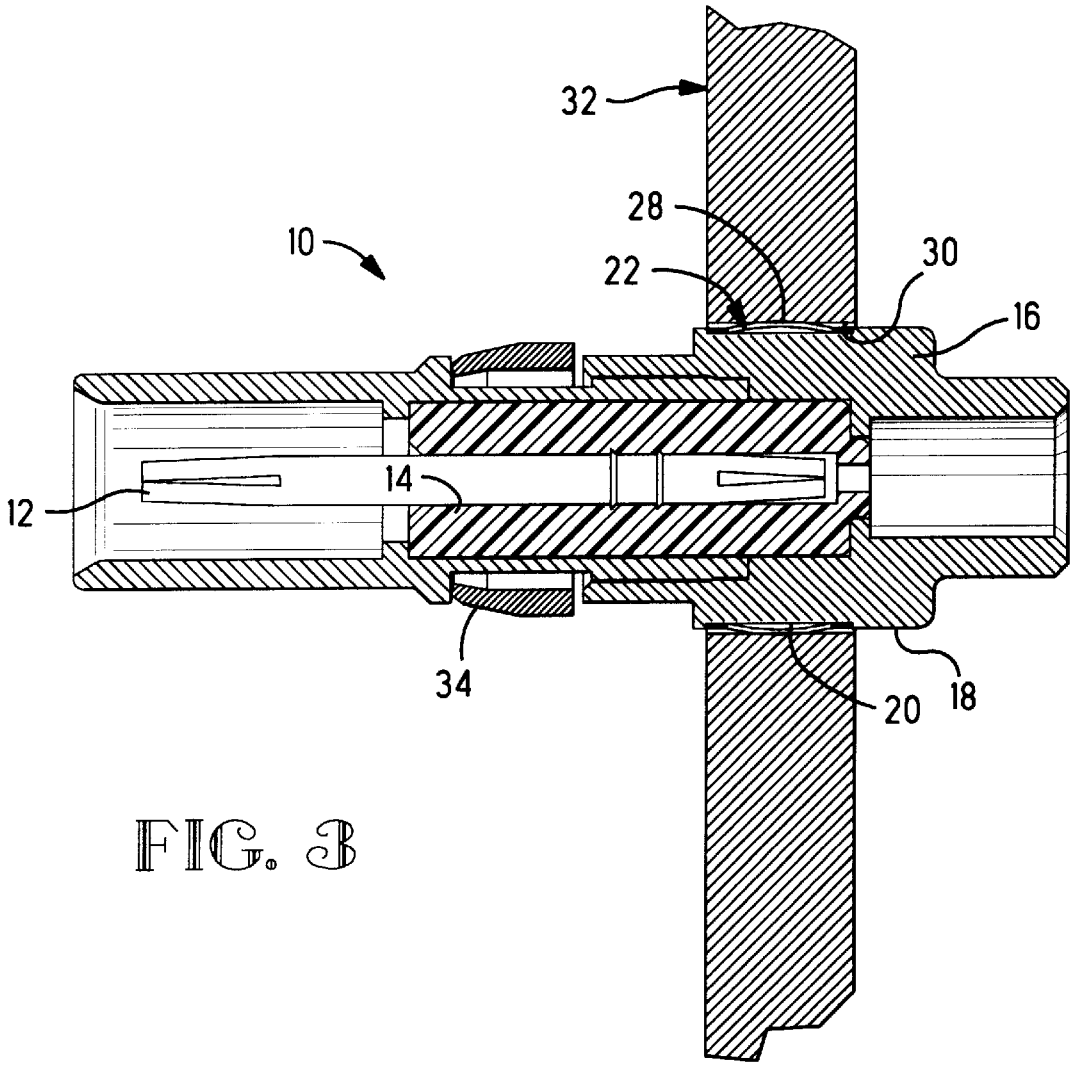
FIG. 3 is a longitudinal cross-sectional view of the coaxial connector of FIG. 1 mounted through a cutout of a bulkhead.

Coaxial connector 10 is shown inserted through a cutout 30 of conductive bulkhead 32, in FIG. 3, to become self-seated within a housing of dielectric material (not shown) mounted to the bulkhead, by means of compressible clip 34 that will snap outwardly when urged forwardly of a ledge of the connector-receiving cavity of the housing, and thereby seat forwardly of the ledge. Contact surfaces 28 have engaged the periphery of cutout 30 and have been deflected radially inwardly toward outer conductor 16 into groove 20, while remaining in grounding engagement with the bulkhead. During urging of the coaxial connector 10 through cutout 30 during either insertion or removal, the contact band remains seated in shallow groove 20 although the bands move relatively apart upon radially inward compression of the spring members. Such an annular band may have, for example, twenty compressible spring members, establishing numerous points of contact with the bulkhead.

Removal of the coaxial connector from the bulkhead is easily accomplished by use of a tool that deflects the clip radially inwardly permitting withdrawal of the connector from the housing and the bulkhead. Previous coaxial connectors were soldered to the bulkhead to establish a ground connection, and desoldering had been required to permit removal of the coaxial connector for repair or servicing.

What is claimed is:

1. A coaxial connector, comprising:

a conductive outer housing, a dielectric insert therewithin and an inner conductor within the dielectric insert;

said conductive outer housing having a shallow groove in an outwardly facing surface thereof; and an annular contact band of spring members around said conductive outer housing disposed in said shallow groove, said spring members being convex outwardly to be engaged and compressed radially inwardly by a periphery of a cutout of a bulkhead when the coaxial connector is inserted through said cutout, establishing a ground connection with said bulkhead, whereby the coaxial connector is easily removable from the bulkhead for repair and service.

2. The coaxial connector as set forth in claim 1 wherein said annular contact band includes a pair of annular bands integrally joined to opposed ends of said spring members of said array.

3. The coaxial connector as set forth in claim 2 wherein said annular contact band self-retains on said outer housing by being spring loaded thereagainst upon being placed therearound.

* * * * *